US005894938A

United States Patent [19]

Ichise et al.

[11] Patent Number: 5,894,938

[45] Date of Patent: Apr. 20, 1999

[54] GLASS CULLET SEPARATION APPARATUS

[75] Inventors: Junichi Ichise; Tatsunori Hayashi; Yasuhiko Ikegami; Yoshio Egashira, all of Takasago; Makoto Kaneuchi, Kobe; Toshio Sanagawa, Kobe; Takeya Kawamura, Kobe, all of Japan

[73] Assignee: Mitsubishi Heavy Industries, Ltd., Tokyo, Japan

[21] Appl. No.: 08/888,396

[22] Filed: Jul. 7, 1997

[30] Foreign Application Priority Data

Jul. 25, 1996 [JP] Japan ..... 8-196209

[51] Int. Cl.[6] ..... B07C 5/00; B07C 5/342; B07C 5/38

[52] U.S. Cl. ..... 209/559; 209/577; 209/579; 209/588; 209/580; 209/644

[58] Field of Search ..... 209/539, 577, 209/580, 581, 582, 588, 524, 910, 920, 925, 644, 559

[56] References Cited

U.S. PATENT DOCUMENTS

| | | | |
|---|---|---|---|
| 2,580,275 | 12/1951 | Bickley | 209/581 |
| 3,279,598 | 10/1966 | Barnard et al. | 209/539 |
| 3,811,567 | 5/1974 | Tomita et al. | 209/644 |
| 5,443,164 | 8/1995 | Walsh et al. | 209/588 |
| 5,456,127 | 10/1995 | Gschweitl | 209/588 |
| 5,641,072 | 6/1997 | Otake | 209/580 |
| 5,755,336 | 5/1998 | Rudy | 209/539 |

FOREIGN PATENT DOCUMENTS

| | | |
|---|---|---|
| 3-89981 | 4/1991 | Japan . |
| 4-16273 | 1/1992 | Japan . |
| 7-132269 | 5/1995 | Japan . |

*Primary Examiner*—William E. Terrell
*Assistant Examiner*—Joe Dillon, Jr.
*Attorney, Agent, or Firm*—Wenderoth, Lind & Ponack, L.L.P.

[57] ABSTRACT

A glass cullet separation apparatus according to the present invention includes a hopper (1), a rotary feeder (6), an inclined guide plate (14), a conveying belt (17), and a foreign glass discrimination device (37). The discriminated device can radiate a laser beam onto a surface of a cullet passing over a slit of the conveying belt (17) for emission therefrom and for discriminating a "yes or no" foreign glass determination by analyzing a spectrum of the emission. Also, included is a color discrimination device (41), a foreign glass discrimination trigger sensor (33), a color discrimination trigger sensor (40), and air nozzles (44) for ejecting the cullet at each predetermined positions which correspond to the cullet of the foreign glass and the cullet of each color. A non-contact type photoelectric sensor (45) is provided for sensing the cullet passing the air nozzle (44). A collection receptacle (42) is provided for collecting the cullet, and a control device (28) is provided for controlling opening and closing of an electromagnetic valve of the air nozzle (44) for ejecting the cullet in response to a predetermined signal.

8 Claims, 9 Drawing Sheets

GLASS CULLET SEPARATION APPARATUS

BACKGROUND OF THE INVENTION

1. Field of the Invention

The present invention relates to a glass cullet separation apparatus, and more specifically to an apparatus for separating, by colors, ordinary glass cullet (broken glass) of glass bottles etc. to be recycled and for separating foreign glass cullet of heat resisting glass etc. which is commingled therein.

2. Description of the Prior Art

Recycling of used bottles and the like is currently taking place, wherein, except those reusable bottles such as for beer and other alcoholic drinks, collected bottles are broken by a crusher into cullet of several tens mm size (dust glass), melted and made use of as recycled products.

The glass bottles to be recycled are required to be separated into transparent glass and each colored glass according to purpose of use but at the stage of collecting and crushing, various kinds of colored glass and unnecessary foreign matter are mingled together. In some cases, there is commingled a heat resistant glass which has a higher melting temperature than ordinary glass so as not to be melted at the time of recycling.

In order to separate or remove such cullet having various colors commingled therein and foreign matter, there is used a conventional apparatus wherein, while crushed cullet is being conveyed by a conveyor etc., iron scraps are removed by a magnet, aluminum fractions by a metal detector etc. and removal of earthenware and separation of cullet into each color are performed manually by workers standing aside a conveyor line. On other hand, as to the heat resisting glass, especially in a state of cullet, it is difficult to discriminate the heat resistant glass by color from ordinary glass. If the two glass types are commingled at the collection stage, they are substantially inseparable by manual work. It is therefore a conventional countermeasure that, with respect to cullet separated for recycling, a sampling inspection is carried out on each certain unit quantity or an inspection is carried out on recycled products (bottles etc.), which requires a substantial amount of work and quality control.

On the other hand, Japanese laid-open patent application No. Hei 3-89981 dated Apr. 14, 1991 (Reference Patent 1) discloses, as shown in FIG. 9, an apparatus which achieves mechanization and automatization of the work of separating foreign matter in cullet. The foreign matter is removed by the use of an image receiver (or an optical detector) 81 for detecting materials separated into several courses or an analytical device 83 for discriminating the cullet and the foreign matter and a respective pusher 82. Further, foreign matter in the cullet material, fed from a hopper 84 and conveyed by a slide table 85, is detected by a light source 86, the image receiver (or optical detector) 81 and the analytical device 83. The cullet and the foreign matter are separated by the pusher 82 so as to pass on to a non-defective shoot 88 and a foreign matter shoot 87, respectively, and to then be stored in a respective container (not shown).

Also, Japanese laid-open patent application No. Hei 7-132269 dated Jan. 21, 1992 (Reference Patent 2) discloses, as shown in FIG. 10, a method and apparatus for automatically separating cullet according to colors. The cullet is screened by a rotary drum 91 so as to fall on a pallet and arrayed, while being vibrated, in plural rows by an arraying feeder 92 and placed on a separation conveyor 93. Thus, color discrimination is achieved by a color discrimination camera 94 provided on each of the rows and, according to each color so discriminated, the cullet is pushed out on a delivery belt 96 of each color by a push-out member (brush) 95. That is, the apparatus of FIG. 10 is composed of the rotary drum 91 for screening fine particles of the cullet, the arraying feeder 92 provided in plural rows, the separation conveyor 93, the color discrimination camera 94, the push-out member 95 and the delivery belt 96 for delivering the cullet pushed out according to the color thereof.

Further, Japanese laid-open patent application No. Hei 4-16273 dated Jan. 21, 1992 (Reference Patent 3) discloses a color separation apparatus for cullet which, as shown in FIG. 11, includes a rotary type dimensional classification with respect to cullet groups classified in sizes by a rotary type dimensional classification device 101, and plural lines of devices. Each line consists of an arraying lane 102, a carrying belt conveyor 103, a first color discrimination conveyor 104, a second color discrimination conveyor 105, a third color discrimination conveyor 106 and a fourth color discrimination conveyor 107. And, downstream of the first to the fourth color discrimination conveyors 104 to 107 there are disposed a color discrimination sensor 108 and a separation device 109 composing a movable slide and a separation shooter 110 for separating the colored glass based on the result of the discrimination.

In conventional color separation and collection of cullet which relies upon manual work, there are problems as follows:

1) Treatment of a large amount of cullet in a short time is impossible because it requires a substantial amount of manual work.
2) If high speed color separation is to be performed, there is a limitation in the manual work as well as a lack of precision in the separation of colors.
3) Work efficiency is low.
4) Work environment is by no means good due to dust etc.
5) For the manual work, a wide work space is necessary and the entire system becomes larger.
6) If heat resistant glass is commingled, discrimination is difficult and separation becomes impossible, which brings about a quality control problem.

Further, in prior art Reference Patent 1, the problems are as follows:

1) While the cullet is sliding on the sliding table, discrimination and separation is performed and irregularities in sliding speed occur due to shape, direction, etc. of each cullet (e.g. whether a bottom face is concave or convex) and in order to effect precise color discrimination and separation in view of such irregularity of speed, it is necessary to make a cullet to cullet space wider which results in a lower treatment speed.
2) After each cullet passes the image receiver (or optical detector) and until it passes the pusher, a next cullet cannot pass the image receiver (or optical detector). For example, after a piece of foreign matter passes the image receiver and until it passes the pusher, if a following cullet passes the image receiver, the latter cullet reaches the pusher before the former piece of foreign matter finishes a discharge action and both of them could be pushed out concurrently by the pusher, or biting of the pusher is caused or, if the cullet is the former and the foreign matter is the latter, decision determination regarding the foreign matter may not be effected. Because of the structure, a cullet to cullet space must be made wider, and thus treatment speed becomes lower and treatment precision becomes worse.

3) Due to irregularity of sliding speed according to shape, direction, etc. of cullet as mentioned in 1) above, if a timing miss of push-out etc. occurs, foreign matter may be discharged into the non-defective shoot and the ratio of foreign matter becomes higher.

4) Because discrimination is performed by the image receiver (or optical detector), discrimination and separation of the heat resistant glass cannot be achieved.

In the prior art Reference Patent 2, problems are as follows:

1) Treatment speed is low because the separation conveyor is an intermittently moving type in which the cullet to be separated is swept down by the push-out member (brush).

2) Treatment speed is low because the apparatus is of a type in which the cullet is caused to fall on the pallet sporadically one by one.

3) Discrimination is performed by the color discrimination camera, and thus discrimination and separation of the heat resisting glass cannot be achieved.

In the prior art Reference Patent 3, problems are as follows:

1) As one discrimination belt conveyor and separation mechanism can perform a separation of one kind only, if the object to be separated includes plural kinds, a multi-stage discrimination conveyor and plural color discrimination devices and separation mechanisms are necessary and thus the apparatus becomes larger and more complicated.

2) As foreign matter is separated first structurally and there is no more discharge shooter for other miscellaneous matter downstream thereof, if a miss occurs in the separation process, the foreign matter will commingle with any of the separated cullet 3) The discrimination is performed by a color discrimination camera, and thus discrimination and separation of heat resistant glass cannot be achieved.

In the prior art as mentioned above, there are problems in that the separation precision is low and the treatment speed is low, or if the treatment speed is to be increased, plural lines of devices in an increased numbers become necessary with the result that the apparatus becomes larger.

SUMMARY OF THE INVENTION

In view of the above circumstances, in order to solve the problems in the prior art in regard to the color separation work of cullet and in the recycling thereof, it is an object of the present invention to provide a glass cullet separation apparatus which is able to enhance the treatment ability per unit hour and to make the apparatus smaller and enhance the separation precision and also to perform separation of foreign glass (heat resistant glass) which is a serious obstacle in the recycling of glass bottles and color separation of cullet to be recycled.

In order to attain the above objects, the present invention provides a glass cullet separation apparatus for separating cullet of ordinary glass and foreign glass such as a heat resistant glass and for separating the various colors thereof. The apparatus includes a hopper; a rotary feeder; an inclined guide plate; a conveying belt; a foreign glass discrimination device for radiating a laser beam onto a surface of the cullet passing on a slit of the conveying belt for emission therefrom and for discriminating a "yes or no" determination with respect to foreign glass by analyzing a spectrum of the emission; a color discrimination device for discriminating colors; a foreign glass discrimination trigger sensor; a color discrimination trigger sensor; an air nozzle for blowing down or ejecting the cullet at each predetermined position corresponding to the cullet of the foreign glass and the cullet of each color; a non-contact type photoelectric sensor for sensing the cullet passing the air nozzle; a collection bin or receptacle for collecting the ejected cullet; and a control device for controlling opening and closing of an electromagnetic valve of the air nozzle for blowing or ejecting the cullet upon a predetermined signal.

More specifically, the present invention relates to a glass cullet separation apparatus for separating cullet of ordinary glass and foreign glass such as a heat resistant glass and for separating the colors thereof. The apparatus includes a hopper for holding the cullet of glass containing the foreign glass supplied from upstream of the hopper and for supplying it downstream at a certain rate; an arraying and supplying means for revolvingly accelerating the cullet supplied from the hopper so as to array it in a row by a centrifugal force and for delivering it continuously at a high rate of speed; an inclined connection plate for accelerating a differential component of the speed of the cullet supplied from the arraying and supplying means and the speed of a cullet conveying belt, which is provided with a belt movement amount measuring means; a foreign glass discrimination device for radiating a laser beam onto a surface of the cullet passing a slit of the conveying belt for emission therefrom and for discriminating with a "yes or no" determination of foreign glass by analyzing a spectrum of the emission; a color discrimination device for causing an illumination light to pass through the slit of the cullet conveying belt and for discriminating the color by taking an image of a transmission light through the cullet which is being conveyed; a first non-contact type photoelectric sensor for triggering a sensing timing of the foreign glass discrimination device; a second non-contact type photoelectric sensor for triggering a sensing timing of the color discrimination device; an air nozzle for ejecting foreign glass and the cullet of each color at a respective predetermined position for separation of the cullet; a third non-contact type photoelectric sensor for sensing a passing of the cullet at the air nozzle; a collection bin or receptacle for receiving the cullet blown down by the air nozzle, and a control device for controlling opening and closing of an electromagnetic valve of the air nozzle for ejecting the cullet upon each of the following signals:

1) a foreign glass discrimination trigger signal obtainable from the first non-contact type photoelectric sensor as a foreign glass discrimination trigger sensor, 2) a color discrimination trigger signal obtainable from the second non-contact type photoelectric sensor as a color discrimination trigger sensor, 3) a foreign glass signal obtainable from the foreign glass discrimination device, 4) a cullet color signal obtainable from the color discrimination device, 5) a belt movement distance pulse signal obtainable from the belt movement amount measuring means, and 6) an electromagnetic valve trigger signal obtainable from the third non-contact type photoelectric sensor as an electromagnetic valve trigger sensor.

By employing the above-mentioned construction, the present invention makes it possible to achieve separation of foreign glass and color separation of the cullet both at a high rate of speed and with a high degree of precision and to provide a compact construction of the apparatus.

The glass cullet separation apparatus of the above-mentioned construction is made preferably as follows:

(1) The arraying and supplying means for supplying the cullet continuously at a high speed is a rotary feeder for arraying the cullet along a rotary disc and a circumferential wall of the disc by use of a centrifugal force and for delivering the cullet in a tangential direction of the disc from a delivery port provided at the wall. Thereby, continuous and high speed supply of the cullet becomes possible.

(2) The controlling device is constructed so as to start a count of a cullet movement amount upon triggering of the foreign glass discrimination trigger signal and the color discrimination trigger signal, to control the cullet movement amount by use of the belt movement distance pulse signal and to produce, upon the foreign glass discrimination signal and the cullet color discrimination signal, an electromagnetic valve enabling signal for the electromagnetic valve of the air nozzle which corresponds to the foreign glass and the cullet of each color. The electromagnetic valve enabling signal has a time width which takes into account slip of the belt and the cullet based on a reference timing in which the cullet should have reached the electromagnetic valve trigger sensor. Also, an electromagnetic valve opening signal is a logical product of an electromagnetic valve opening enabling signal and the electromagnetic valve trigger signal. Thereby, the cullet flowing at a high speed and the cullet which has a position on the belt that is slightly deviated due to slip with the belt can be accurately ejected from the belt by the air nozzle for each color and thus separation and collection thereof is ensured.

(3) The cullet conveying belt is provided at a drive shaft or a pulley shaft with a means, such as an encoder, for measuring a rotation amount. Thereby, the amount of movement of the cullet, being conveyed by the belt, can be measured.

(4) The collection bins or receptacles are arranged in an order of collection in which the cullet, which makes up a smaller percentage of the total mix, is collected upstream with respect to cullet which represents a larger percentage of the total mix. Thereby, the cullet which represent the smallest percentage of the mix is collected upstream of the other cullet, while the cullet representing the largest percentage of the mix is collected downstream of the other cullet which represent lesser percentages of the mix. Thus, a separation of the cullet can be accurately performed.

(5) The cullet conveying belt is formed at a portion of the belt with a slit (cut-out portion) through which a laser beam, necessary for discriminating foreign glass, and a transmission light (illumination light), necessary for discriminating colors of the cullet, may pass while the cullet is being conveyed. Thereby, while the cullet is being conveyed with a single stage construction, discrimination of the foreign glass and the cullet of each color and separation of many kinds of cullet is possible.

(6) The cullet conveying belt is driven by a servomotor. Thereby, start of jetting, time length of jetting, etc. of the air nozzle can be timed precisely to effect the separation.

(7) In the glass cullet separation apparatus, the particular construction results in the cullet being separated by blowing the cullet from the belt into a bin or receptacle by a separation means which employs air jets etc. and other foreign matter is collected at a terminal end of the conveying belt without the use of a separation means. Thereby, even if there is a failure in the separation, there occurs no degradation of the collection purity in the respective collection bin or receptacle.

(8) In the glass cullet separation apparatus, the particular construction results in discrimination of foreign glass, discrimination of color and plural separations thereof are performed by one line. Also, the plural color discriminations are performed by a single color discrimination device. Thereby, the apparatus can be made more compact.

In the present invention, the hopper serves to hold the supplied cullet, as well as to supply the cullet to the downstream rotary feeder at a certain rate.

The rotary feeder is an arraying and supplying device in which cullet of different sizes and shapes is arrayed in a row and is continuously supplied therefrom for a precise discrimination and determination of the foreign glass and the cullet of each color and for separation and collection thereof, both to be performed on the downstream side. The feeder is made as a twofold structure comprising an inner ring and an outer ring, which are each rotatable. Therefore, the cullet, which is supplied continuously on the inner ring side from the hopper, steps up by a centrifugal force on the inner ring, which rotates in an inclined orientation, and then can move on to the outer ring which rotates around an outer periphery of the inner ring. An annulus width of the outer ring is made approximately equal to or slightly smaller than the cullet, and thus, at the time of movement from the inner ring, a sequence of single pieces of the cullet is placed on the outer ring. The cullet, arrayed in a row, then moves on the outer ring in a circumferential direction along an outer peripheral portion of a guide plate due to a centrifugal force created by rotation of the outer ring and thus can be delivered continuously in a tangential direction of the outer ring from a delivery port provided at a portion of an outer wall of the feeder.

The inclined connection plate for connecting the rotary feeder and the conveying belt functions to smoothly place the cullet delivered from the rotary feeder onto the conveying belt and to effect an acceleration thereof by a differential speed between the speed of the cullet coming out of the rotary feeder and that of the conveying belt.

The conveying belt is for conveying the cullet supplied from the rotary feeder via the connection plate and, as it is set to move at a slightly higher speed than the rotary feeder, a cullet to cullet space can be spread due to the differential speed even if the cullet is linked. The belt is constructed by four belts which are rotatable by a single drive shaft and a slit-like cut out portion is formed at an intermediate portion of the belt upper face, and thus, without employing a multi-stage or multi-series structure, discrimination of foreign glass and the cullet of each color by use of a laser beam radiation and an illumination light transmission becomes possible. Thus, the whole apparatus can be made more compact since the separation device for separating the cullet can be disposed downstream of the belts. On both sides of the belt on which the cullet moves, there are provided guide plates so that the cullet may not spread but is constrained to move in a state arrayed in a row. Also, there is provided a brush-like guide member on one side of the guide plates so that the flowing cullet is biased to the other side of the guide plates, thereby the cullet always passes on the slit provided adjacent the other side of the guide plates. Thus, discrimination and determination of the foreign glass and the cullet of each color can be achieved without omission. Further, for driving the belt, a servomotor containing an encoder is employed, thereby speed control can be achieved, and a pulse signal of the encoder and a trigger signal of a photoelectric sensor, as described later, are combined, thereby control of the passing cullet becomes possible.

The foreign glass discrimination device functions to cause a laser beam source to radiate a laser beam to a surface of the cullet passing over the slit of the conveying belt for an instantaneous emission therefrom and to analyze a spectrum of the emission in real time for a high speed discrimination of the ordinary glass and the heat resistant glass and to emit a signal indicative of the heat resistant glass (foreign glass) Generally, the heat resistant glass can be discriminated by analyzing a differential characteristic spectrum such that an alkaline content such as calcium of the heat resistant glass is lower than that of the ordinary glass.

The color discrimination device causes a light from an illumination lamp disposed under the slit of the conveying belt to pass through the cullet passing on the slit. A discrimination camera, disposed at an opposing position of the lamp, is caused to take an image of the cullet, and make a color discrimination of the cullet image so taken by way of image processing and then emits a color signal.

The first non-contact type photoelectric sensor for triggering the foreign glass discrimination device detects the cullet passing on the slit of the conveying belt, which becomes a signal for a radiation timing of the laser beam from the laser beam source of the foreign glass discrimination device.

The second non-contact type photoelectric sensor for triggering the color discrimination device also detects the cullet passing on the slit of the conveying belt, which emits a signal for a shutter timing for the discrimination camera of the color discrimination device to take an image of the cullet.

The third non-contact type photoelectric sensor, for sensing a passing of the cullet at the air nozzle portion, is positioned slightly upstream of the respective air nozzle for the foreign glass and the cullet of each color which are the objects to be separated. The sensor senses the passing cullet, which becomes a signal for the timing of the air nozzle.

The air nozzle jets a pressurized air at a respective predetermined position of the foreign glass and the cullet of each color upon the electromagnetic valve being opened by a command signal from the control device. The jetted air blows the cullet from the belt in order to separate it into the respective collection bin or receptacle which is disposed in an opposing position relative thereto.

The collection bin or receptacle is disposed for each color of the cullet and receives the cullet blown by the air nozzle.

The control device, starting upon a foreign glass discrimination trigger signal and a color discrimination trigger signal, controls the timing of opening the electromagnetic valve of the air nozzle in response to a foreign glass discrimination signal and a cullet color discrimination signal as well as a belt movement distance pulse signal (encoder) and, upon coinciding with a cullet passing signal at the air nozzle portion (electromagnetic valve trigger signal) the control device opens the electromagnetic valve.

The function of the control device is described in detail below. The cullet flows on the slit of the conveying belt, upon triggering of a foreign glass discrimination trigger signal and a color discrimination trigger signal, a laser beam radiation for foreign glass discrimination and shutter opening of the discrimination camera, respectively, is commenced for discrimination of the passing cullet. Concurrently, counting of the cullet movement amount is commenced so that the cullet movement amount is controlled by use of the belt movement distance pulse signal. While the movement amount is being counted, a "yes or no" determination of foreign glass and color of the cullet is output by the foreign glass discrimination device and the color discrimination device. Based on the foreign glass discrimination signal and color discrimination signal, the control device makes an estimate of the movement amount with which the cullet reaches a corresponding air nozzle for separation of that particular cullet. In a case where the cullet reaches the estimated point late due to a slip with the belt etc. or advances earlier to the estimated point due to a change of posture etc., the control device produces an electromagnetic valve opening enabling signal for the air nozzle having a time correction corresponding to the delay or advance. While the electromagnetic valve opening enabling signal is in a state of "ON", if a valve trigger switch is turned to "ON", a cullet blowing enabling and a cullet blowing timing coincide with each other. Thus, if the electromagnetic valve of the air nozzle is opened at this time, the cullet is blown toward the collection bin or receptacle. An electromagnetic valve opening signal is produced as a logical product of the electromagnetic valve opening enabling signal and the electromagnetic valve trigger signal, thereby separation and collection of the foreign glass and the cullet of each color can be achieved reliably even with respect to such cullet which flows continuously at a high speed or as has a slight deviation of position on the belt due to a slip with the belt etc.

The conveying belt is provided at its pulley shaft with a means such as an encoder etc. for measuring a rotation amount. Thereby a movement amount of the cullet corresponding to the belt rotation can be output as a pulse signal. As the conveying belt is driven by a servomotor, a sensor signal for sensing rotational speed can be fed back in order to control the rotational speed, and thus a moving speed of the cullet can be controlled.

The cullet separation device is constructed so that the cullet as an object to be separated is blown into the collection bin or receptacle by use of a separation means and foreign matter is collected at a terminal end of the conveying belt without the use of a separation means. In case of the occurrence of a failure in the separation process, the cullet simply does not fall into one of the collection bins or receptacles for each color but is instead collected as foreign matter in a foreign matter collection device located at a rear end portion of the conveying belt.

DESCRIPTION OF THE PREFERRED EMBODIMENTS

A description is made below of a glass cullet separation apparatus according to one preferred embodiment of the present invention with reference to FIGS. 1 to 8.

Figure 1:
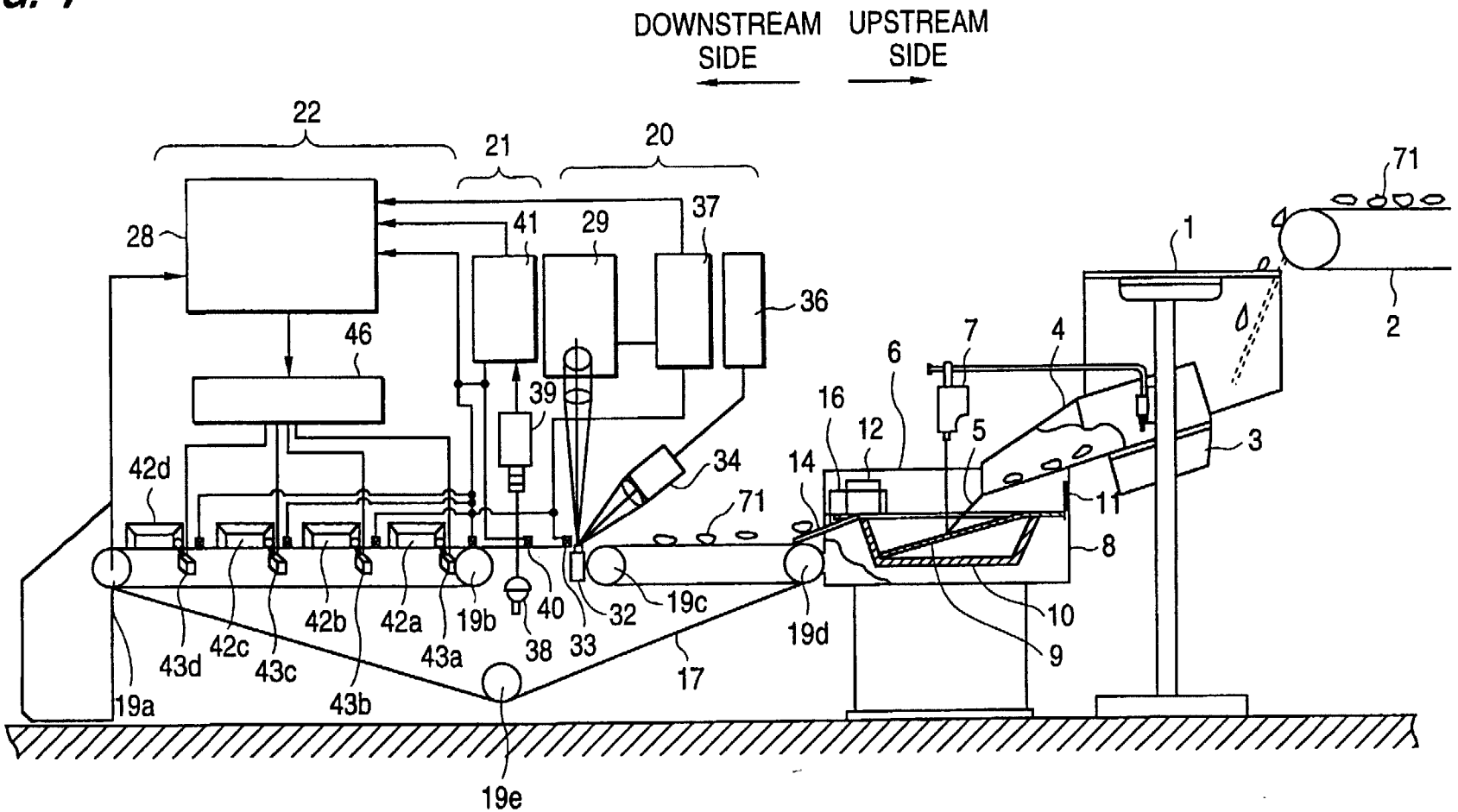
FIG. 1 is an entire side view of a glass bottle cullet separation apparatus in accordance with a preferred embodiment of the present invention.
Figure 2:
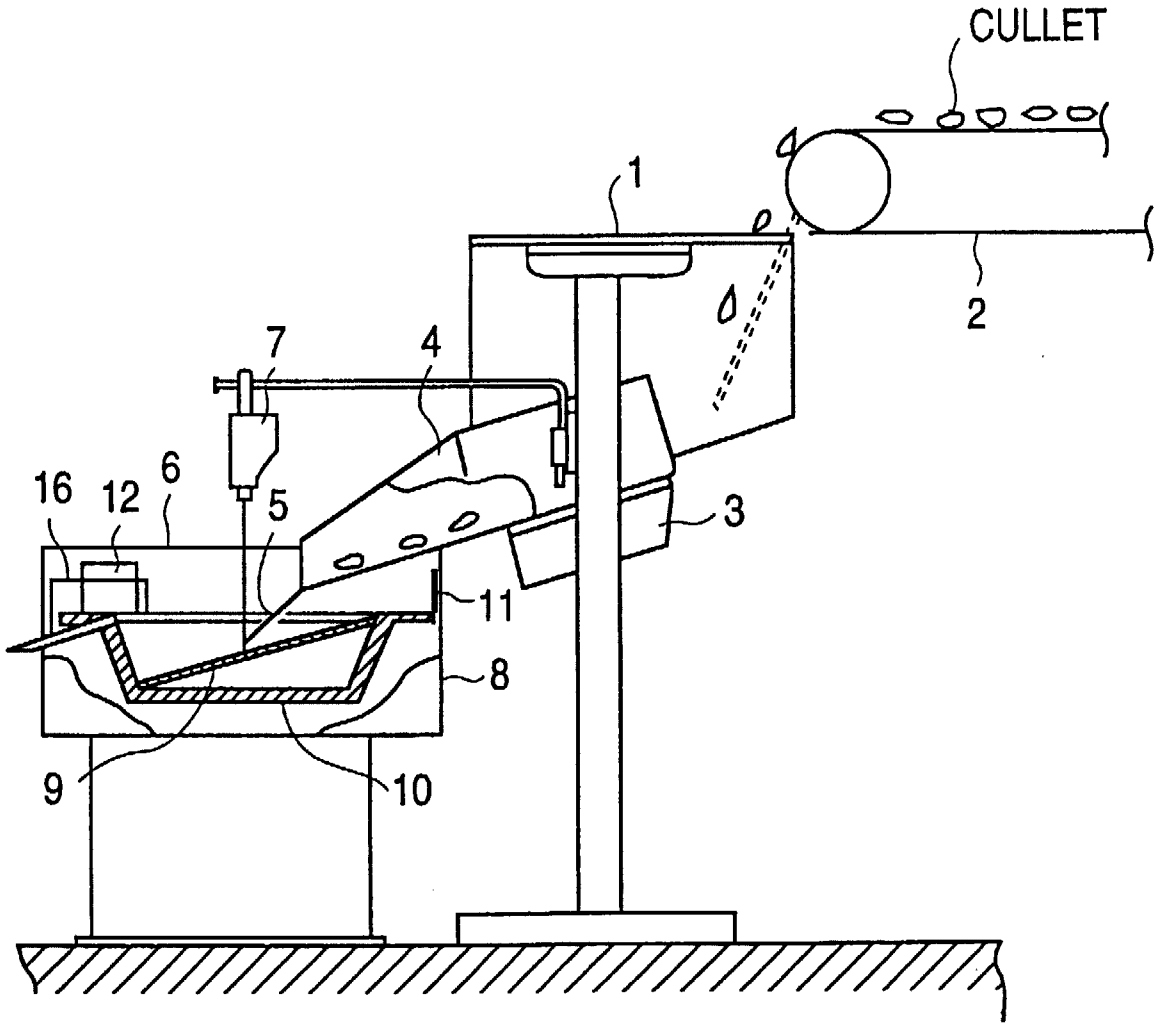
FIG. 2 is an enlarged side view showing an upstream portion of the separation apparatus of FIG. 1.
Figure 3:
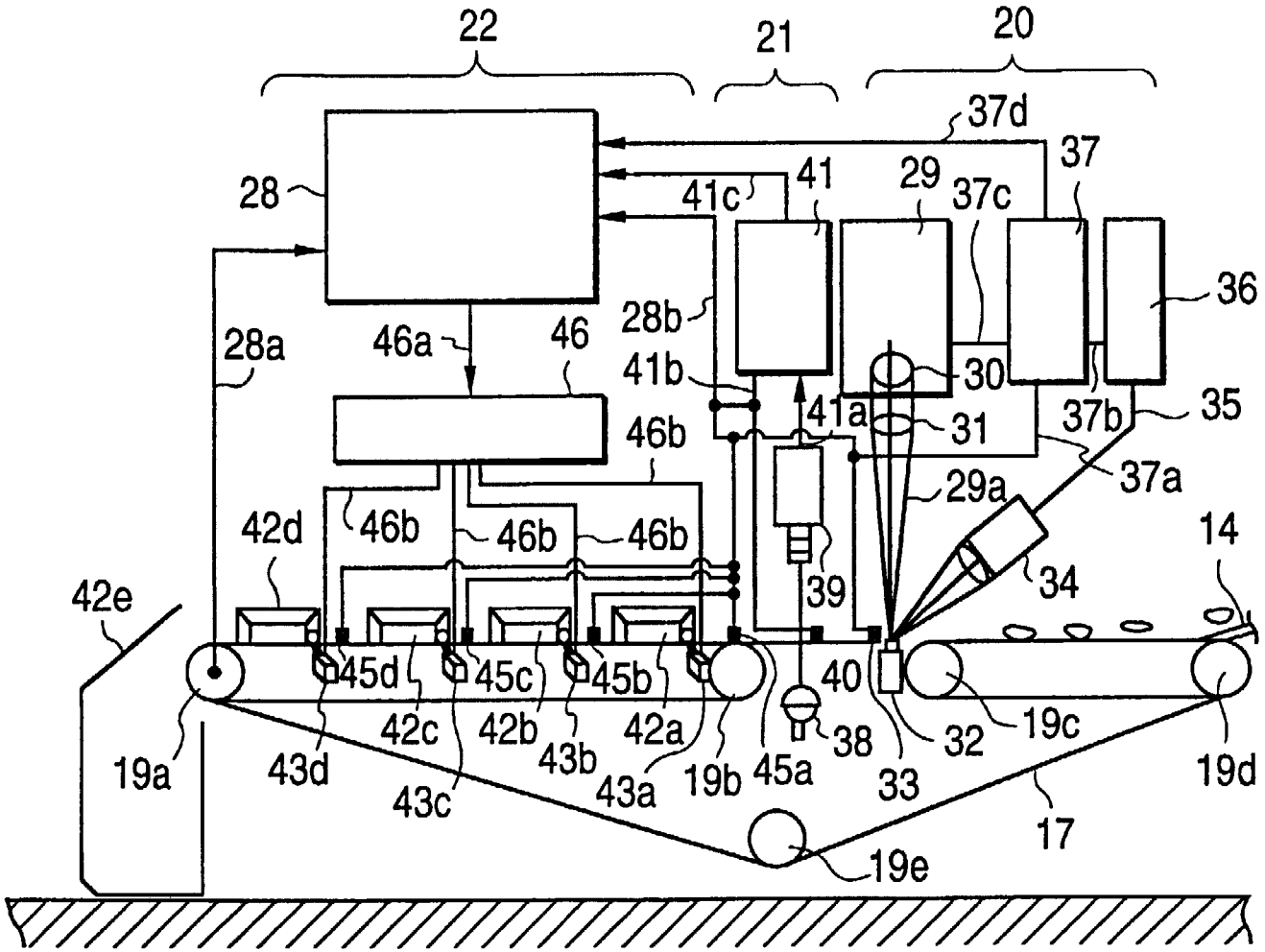
FIG. 3 is an enlarged side view showing a downstream portion of the separation apparatus of FIG. 1.

As to the construction of the glass cullet separation apparatus shown in FIGS. 1 to 3, a hopper 1 is disposed on an upstream side with respect to a flow of cullet to be separated. Empty bottles of various colors collected from general household, public facilities, etc. are broken and crushed by a crusher etc. (not shown) into appropriate sizes and are screened by a screening device (not shown) into several classes of sizes, for example, 10 to 30 mm, 30 to 50 mm, 50 to 70 mm, etc. so that each class of the sizes flows on a respective line.

The cullet separation apparatus of FIGS. 1 to 3 shows a construction of one line for one class of sizes of the cullet 71 so screened at a previous stage, and the cullet 71 of 30 to 50 mm class of sizes, for example, screened at the previous stage is fed into the hopper 1 from a supplying belt 2.

Within the hopper 1, there is a detecting sensor composed of a limit switch etc. (not shown) for controlling a feeding amount from the supplying belt 2, so that a remaining amount of the cullet fed into the hopper 1 is always controlled so as to be a predetermined amount.

A vibrator 3 is provided at an inclined bottom face of the hopper 1 for generating vibrations so that the cullet held in the hopper 1 is supplied from a feeding port 4 to a rotary feeder 6 provided downstream thereof via an inclined guide plate 5 at a rate of speed which corresponds to the vibration.

At the hopper 1, there is provided a detecting sensor 7, as shown in the FIG. 1, composed of a limit switch etc. for detecting an amount of the cullet 71 within the rotary feeder 6. Thereby, if the amount of the cullet 71 exceeds a predetermined amount (i.e. at a time of excess supply), the vibrator 3 is turned to "OFF" and if the amount of the cullet 71 is less than the predetermined amount, the vibrator 3 is turned to "ON", and thus the amount of the cullet 71 supplied into the rotary feeder 6 is automatically controlled.

The rotary feeder 6 functions, while rotating, to array the cullet 71, supplied from the hopper 1, "one by one" in a row by a centrifugal force for delivery of the cullet downstream. FIG. 5 is a cross sectional view taken on line V—V in a direction indicated by the arrow shown in FIG. 4.

In FIGS. 1 to 3 and in FIG. 5, numeral 8 designates an outer wall, numeral 9 designates an inner disc, numeral 10 designates an outer disc, and numeral 11 designates a guide wall. A delivery port 12 is provided at an outer circumferential portion of the outer wall 8 for delivery of the cullet. The outer disc 10 and the inner disc 9 are driven rotationally by motors 13*a* and 13*b*, respectively. Both discs are constructed, as shown in the figure, such that the inner disc 9 is assembled within the outer disc 10 which is of a mortar-shape. A rotational axis of the outer disc 10 is in a vertical orientation and a rotational axis of the inner disc 9 is inclined. An upper edge portion of the inner disc 9 and an upper face of the outer disc 10 are disposed at positions of equal level or height as shown in intersection area A in FIG. 5.

Also, the guide wall 11 is fitted to the outer wall 8 of the rotary feeder 6 so as to not contact the upper face of the rotating outer disc 10. The guide wall 11 is constructed such that its inner radius widens gradually in a rotational direction from the intersection area A toward the delivery port 12.

Figure 4:
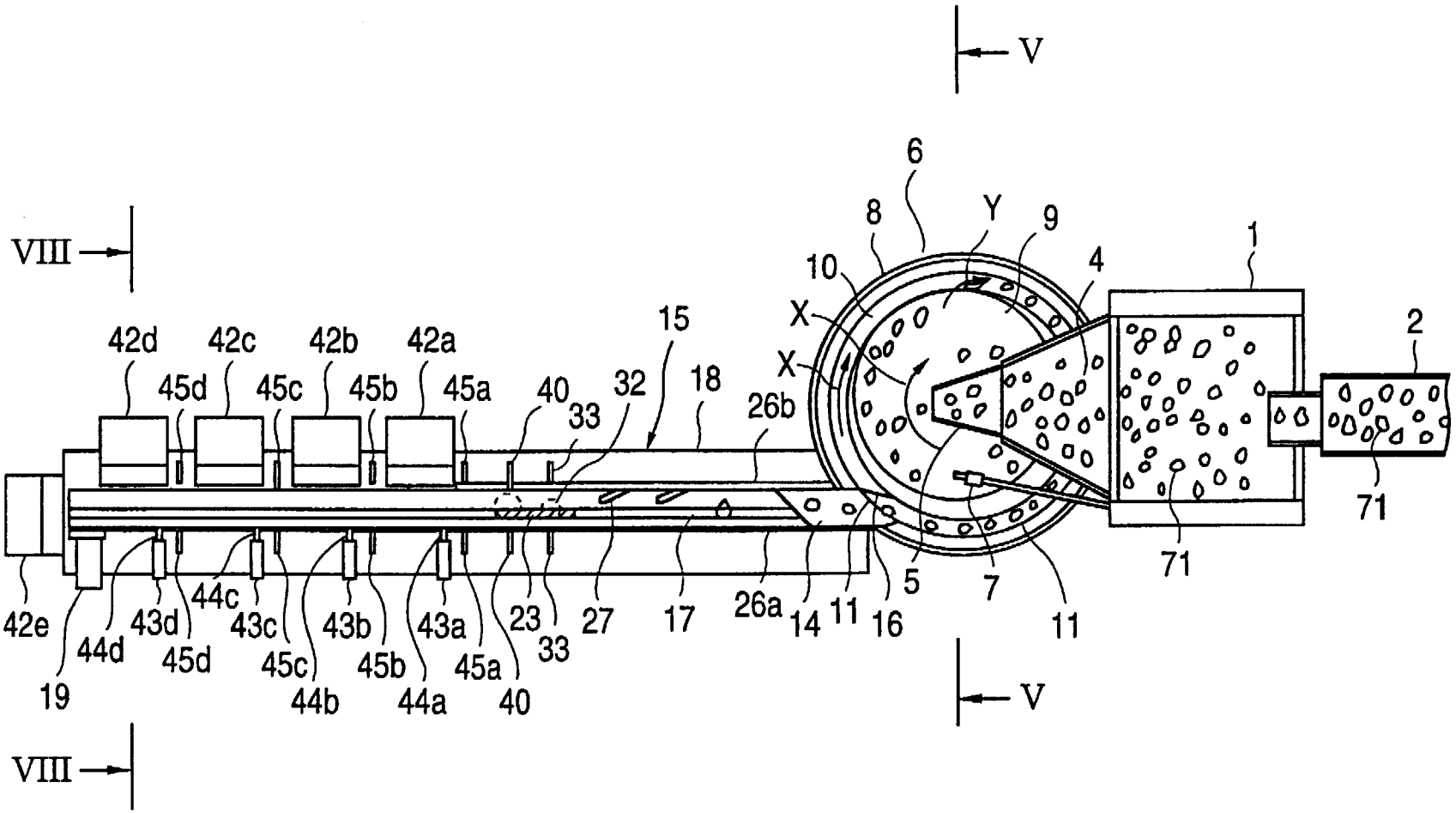
FIG. 4 is a plan view of the separation apparatus of FIG. 1.
Figure 5:
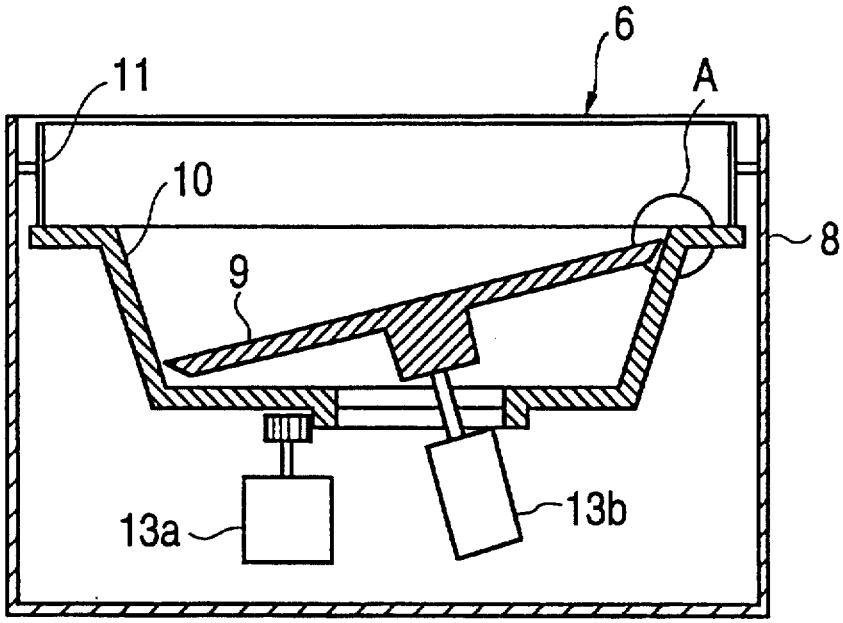
FIG. 5 is a cross sectional view taken on line V—V in the direction of the arrow in FIG. 4.

By rotation (in the direction of arrow X in FIG. 4) of the inner disc 9 and the outer disc 10, the cullet supplied on the inner disc 9 is caused by the centrifugal force to step up one by one on an outermost circumferential portion of the inner disc 9 in the direction of arrow Y in FIG. 4 so as to be placed on the upper face of the outer circumference of the outer disc 10. The cullet is moved in an array along an inner side of the guide wall 11 due to the centrifugal force so as to be delivered continuously from the delivery port 12 which opens at the outer wall 8. The rotational speed of the outer disc 10 and the inner disc 9 can be controlled by the motors 13*a* and 13*b*, respectively, and thus an arrayed supply can be provided at a low speed or a high speed.

Numeral 14 designates a connection plate disposed near the delivery port 12 for connecting the rotary feeder 6 and a downstream conveying device 15. By the connection plate 14, which is appropriately inclined downward from an upstream side toward a downstream side, the cullet delivered from the rotary feeder 6 via a guide plate 16 and the delivery port 12 can glide without deceleration (with acceleration) and move onto a conveying belt 17 without rolling.

The conveying belt 17 functions to convey the cullet delivered from the rotary feeder 6 via the inclined connection plate 14 with an increased cullet to cullet spacing and with restricted movement in a widthwise direction. Numeral 18 designates a conveying device body, which is composed of a drive system 19 for the conveying belt 17, a foreign glass discrimination portion 20, a color discrimination portion 21, a separation portion 22 and a guide plate, as described below, for restricting the cullet in the widthwise direction.

Figure 6:
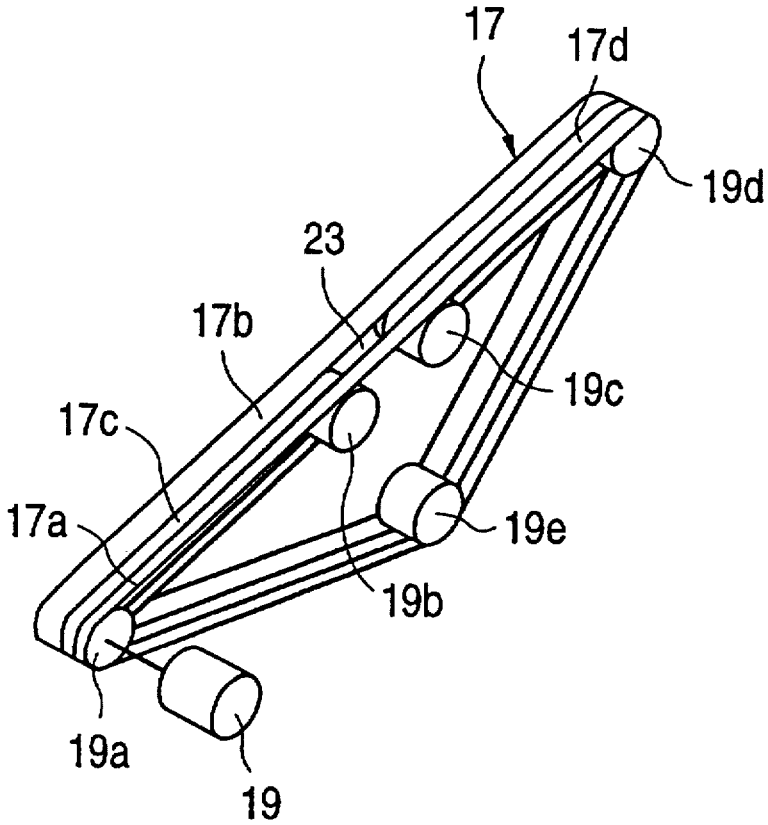
FIG. 6 is a perspective view of a conveying belt which is one component of the glass bottle cullet separation apparatus of FIG. 1.
Figure 7:
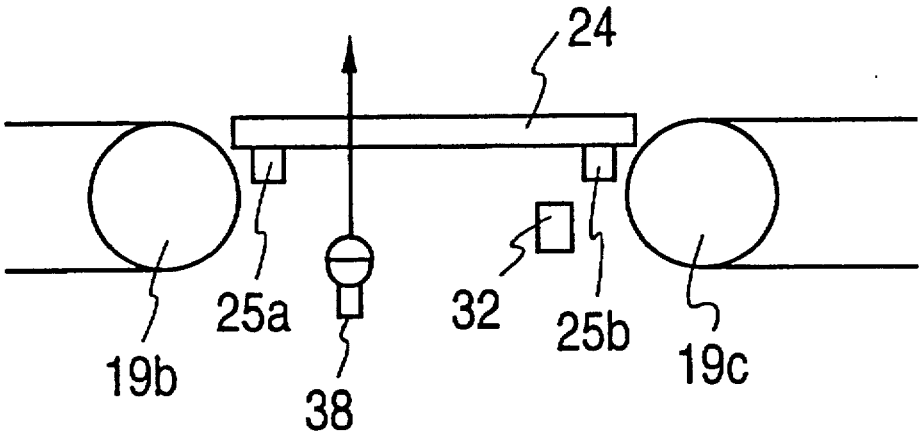
FIG. 7 is an explanatory view showing details of the apparatus in a vicinity of a slit of the conveying belt of FIG. 6.
Figure 8:
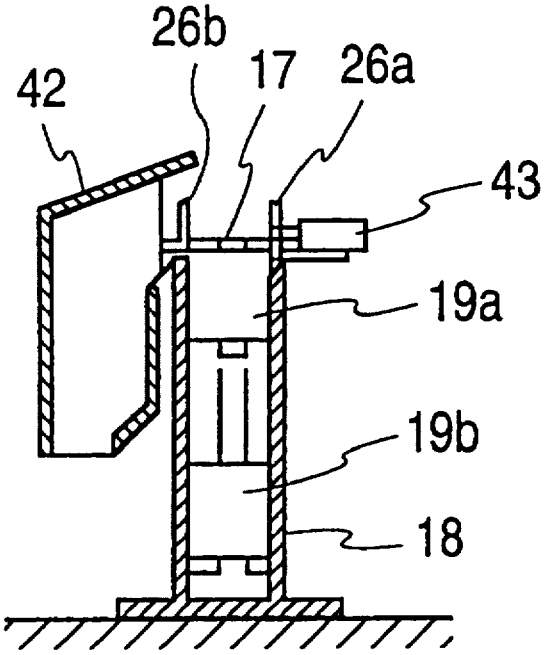
FIG. 8 is a cross sectional view taken on line VIII—VIII in the direction of the arrow in FIG. 4.
Figure 9:
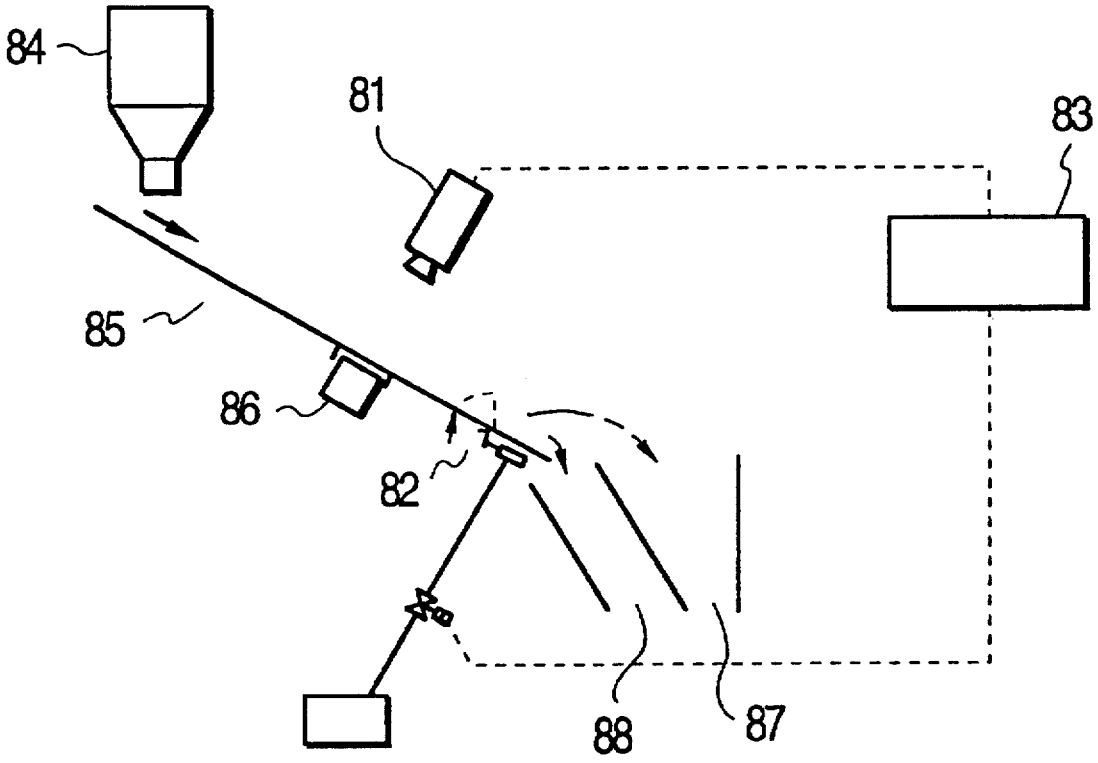
FIG. 9 (PRIOR ART)
FIG. 9 is a view showing a basic construction of one cullet separation apparatus which is known in the prior art.
Figure 10:
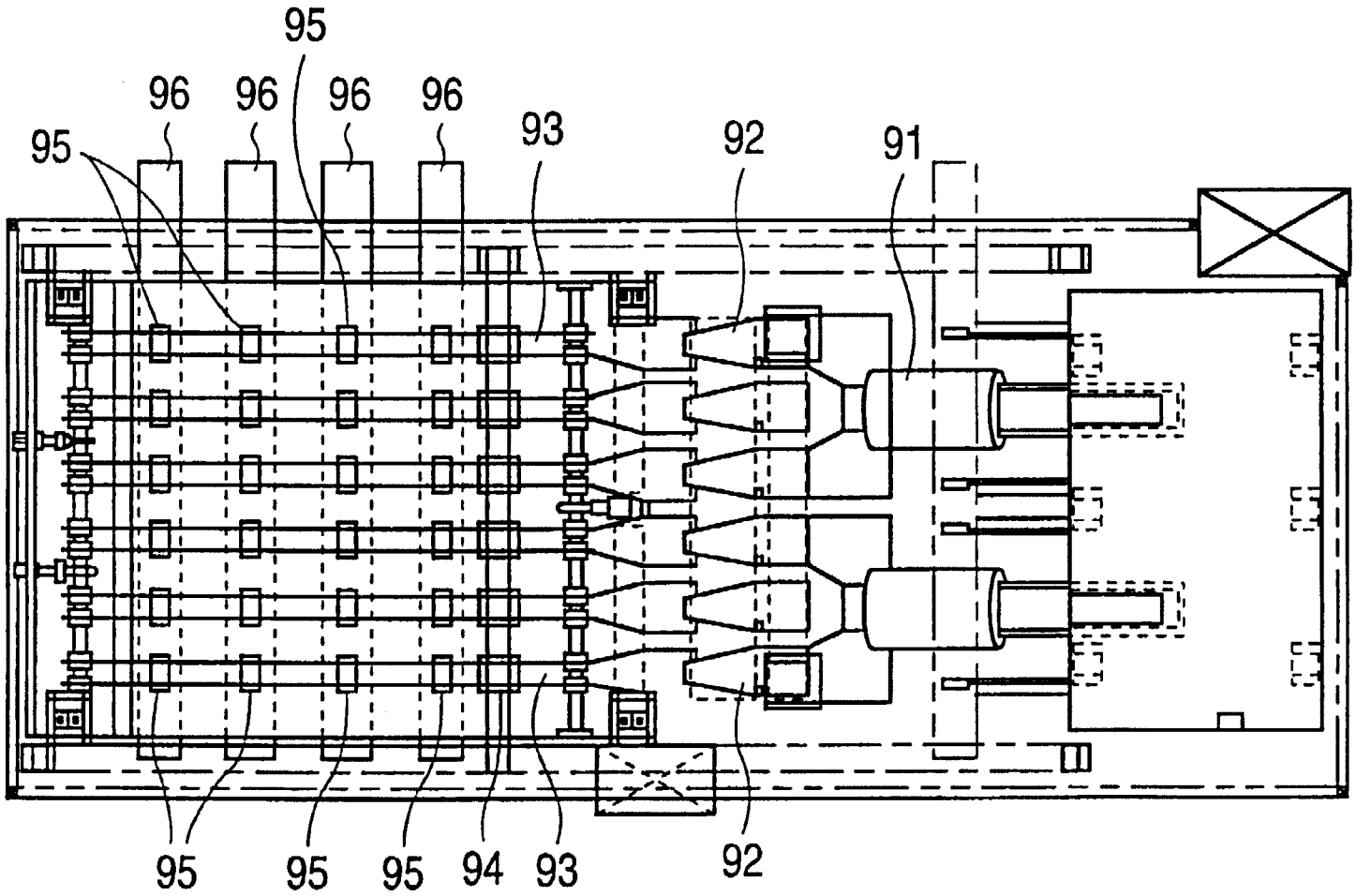
FIG. 10 (PRIOR ART)
FIG. 10 is a view showing a basic construction of another cullet separation apparatus which is known in the prior art.
Figure 11:
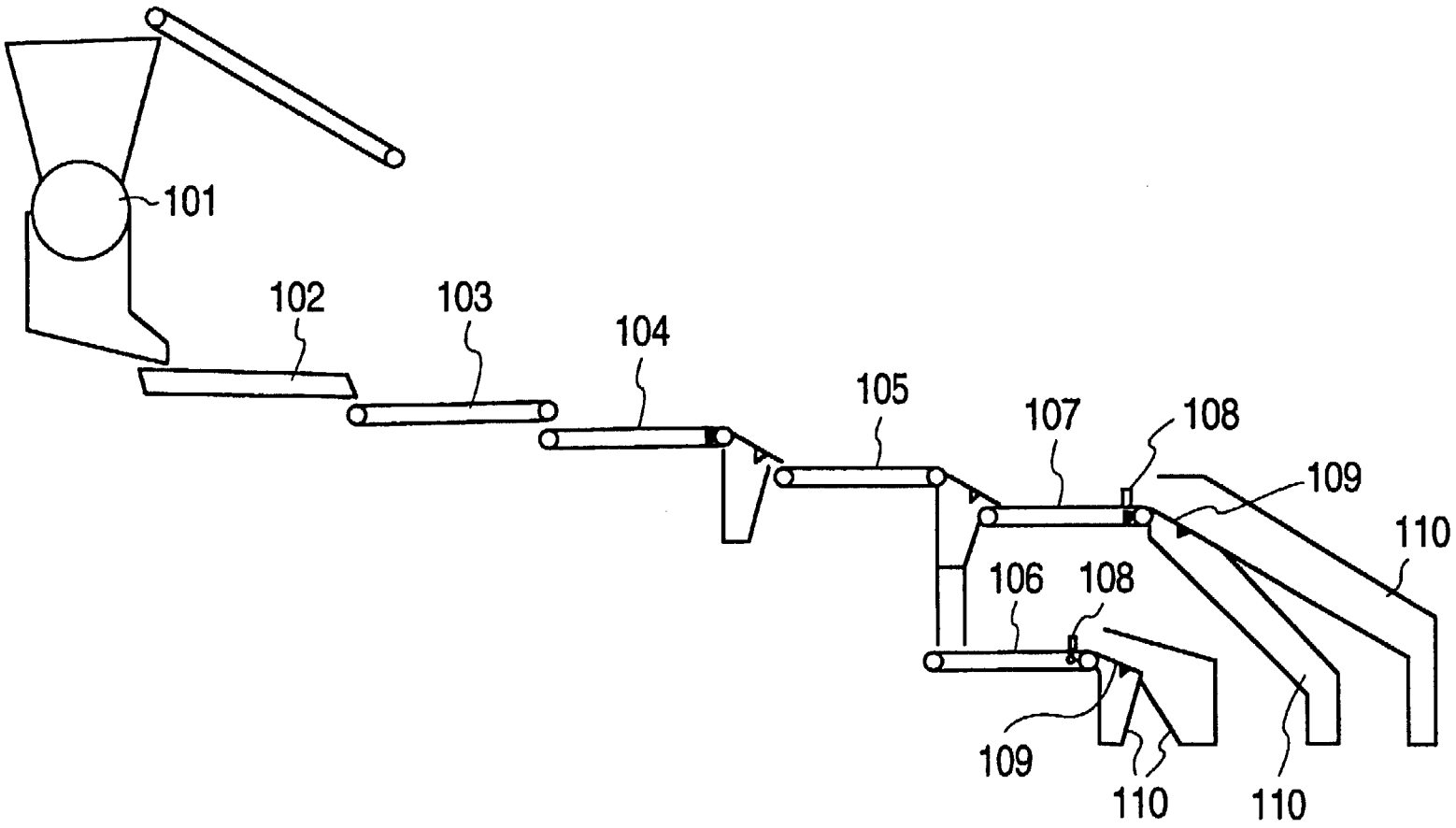
FIG. 11 (PRIOR ART)
FIG. 11 is a view showing a basic construction of still another cullet separation apparatus which is known in the prior art.

As shown in FIG. 6, the conveying belt 17 is composed of four conveying belts 17*a*, 17*b*, 17*c* and 17*d* and has a slit 23 (cut-out portion) at a central portion of the belt through which radiation of a laser beam and transmission of an illumination light can be transmitted for discrimination of the foreign glass and for color discrimination of the cullet. Incidentally, a widthwise size of the slit 23 is generally no more than a half of each cullet size and, as shown in FIG. 7, a transparent plate 24 which can transmit an illumination light from an illumination lamp 38, as described later, is supported under the slit 23 by supporting members 25*a* and 25*b*.

The outer side conveying belts 17*a* and 17*b* are driven rotationally by a drive pulley 19*a* as a base point in a loop having nearly a triangle shape formed by drive pulleys 19*b*, 19*c*, 19*d* and 19*e*. The center belt 17*c* is driven rotationally in the loop via the drive pulleys 19*a* and 19*b* and the belt 17*d* is driven rotationally in the loop via the drive pulleys 19*c* and 19*d*. These rotational drives are transmitted via each of the belts and pulleys driven by rotation of the drive pulley 19*a* which is driven by a drive motor 19 fitted at a rear portion (downstream) of the conveying device body 18, such that all of the belts can be moved at the same speed. Also, the slit 23 can be provided at a central portion of the drive pulleys 19*b* and 19*c* and the belts 17 are constructed as if they were a single belt having a central cut-out portion. The slit 23 has a width of several mm and can be formed between the belts 17*c* and 17*d*. The slit is required for radiation of a laser beam to, and for color discrimination by a color discrimination camera of, a passing cullet. Further, the widthwise directional position of the slit 23 is biased to the side of a guide plate 26*a*, and the cullet necessarily passes thereon even if there are differences in sizes of the passing cullet.

The cullet supplied from the rotary feeder 6 is placed on an upstream side of the belts 17*a*, 17*b* and 17*d* via the inclined connection plate 14. The construction is such that a passing width of the belts 17 is restricted by the guide plates 26*a* and 26*b* fitted to the conveying device body 18 so as to be slightly larger than a largest size of a passing cullet. Also, a brush-like guide member 27 is provided on the upstream side of the belts 17, and thus the passing cullet is biased toward the guide plate 26*a* from the center of the belts 17 so as to necessarily pass over the slit 23 while moving toward the downstream side.

The drive motor 19 is a servomotor which is able to easily control the speed of the conveying belts 17. The drive member has an encoder which enables detection of a moving distance of the conveying belts 17. The speed of the conveying belts 17 is usually slightly higher than that of the rotary feeder 6 and due to the difference in speed, the space between each cullet can be increased even if there occurs a linking of the cullet supplied from the rotary feeder 6. Control of the drive motor 19 is effected by a separation control device 28 as described later, via a cable 28*a*.

The foreign glass discrimination portion 20 is composed of a laser beam source 29, a mirror 30 and a convergent lens 31 for converging and radiating a laser beam to the cullet, a beam stopper 32 for intercepting the laser beam under the slit 23, a transparent substance detecting sensor (foreign glass discrimination trigger photoelectric sensor) 33 for causing a radiation timing of the laser beam source 29 to synchronize with the passing cullet, and an emission convergent lens 34, an optical fiber 35, an analyzer 36 and a foreign glass discriminator 37. The foreign glass discriminator converges an emission from a surface of the cullet, analyzes an emission spectrum and discriminates the foreign glass (heat resisting glass).

The laser beam source 29 is disposed, as shown in FIGS. 1 and 3, so as to be able to project a beam to the surface of the cullet passing on the slit 23 of the conveying belts 17, thereby causing the laser beam to converge via the mirror 30 and the convergent lens 31 and to radiate to the surface of the cullet for emission therefrom on an upstream side of the illumination lamp 38.

The beam stopper 32 is fitted immediately under the portion where the laser beam 29*a* passes through the slit 23 and intercepts the laser beam 29*a* so that the laser beam 29*a*, after passing the slit 23, may not radiate to an under portion of the conveying belts 17.

The emission convergent lens 34 functions to converge a beam emitted from the surface of the cullet due to radiation of the laser beam 29*a*. The emission convergent lens 34 is installed above the conveying belts 17, as shown in FIGS. 1 and 3, and the converged beam is sent to the analyzer 36 via the optical fiber 35.

The analyzer 36 makes a spectrum analysis of the converged beam and sends an analyzed signal to the foreign glass discriminator 37, so that the foreign glass discriminator 37 discriminates between ordinary glass or heat resistant glass, etc. due to a difference of the spectrum.

As for the radiation timing of the laser beam 29*a*, as there are delicate differences in size, shape, passing speed, etc. of each cullet, in order to make an accurate radiation to the surface of the cullet passing at a high speed, it is necessary to synchronize the laser beam source 29 with the passing of the cullet. For this purpose, construction is so made that the laser beam source 29, upon receiving a signal from the transparent substance detecting photoelectric sensor 33, as described later, can make a concurrent radiation.

The transparent substance detecting photoelectric sensor 33 functions to detect the passing of the cullet, and to transfer a trigger signal for causing the radiation timing of the laser beam source 29 to synchronize and a signal for the separation portion 22 to adjust a timing for separation of the foreign glass. The photoelectric sensor 33 is disposed at a position so as to be able to reliably detect the passing cullet on the conveying belts 17.

The foreign glass discriminator 37 has a function of discriminating the foreign glass of the passing cullet upon a signal from the analyzer 36, a function of controlling synchronization of the trigger signal (sensor 33) and the radiation of the laser beam source 29, and a function of transferring a signal etc. as to the result of discrimination of the foreign glass to the separation portion 22, as described later, for separating the foreign glass. These signals are transferred via cables 37*a*, 37*b*, 37*c* and 37*d*.

The color discrimination portion 21 is composed of an illumination lamp 38, a transparent substance detecting photoelectric sensor (color discrimination trigger photoelectric sensor) 40 for causing shutter opening and closing of the color discrimination camera 39 to synchronize with the passing of the cullet, and a color discrimination device 41 for making a color discrimination and decision regarding the passing cullet upon receiving a signal from the color discrimination camera 39. The illumination lamp 38 is fitted under the slit 23 of the conveying belts 17 and exposes a light to the color discrimination camera 39 fitted at an opposing position via the slit 23. The color discrimination camera 39 takes an image of each cullet passing over the slit 23 by a light transmitting from the illumination lamp 38 and sends a signal of the image to the color discrimination device 41 for making a color discrimination.

As for the timing of taking the image, as there are delicate differences in the size, shape, passing speed, etc. of each cullet, it is necessary to cause the shutter of the color discrimination camera 39 to open timely with the passing of the cullet in order to make a reliable color discrimination of the cullet passing at a high speed. For this purpose, the color discrimination camera 39, upon a signal from the transparent substance detecting photoelectric sensor 40, can open the shutter synchronously.

The transparent substance detecting photoelectric sensor 40 functions to detect the passing of the cullet and thereupon to transfer a trigger signal for causing the shutter timing of the color discrimination camera 39 to synchronize. The sensor 40 also transmits a signal for the separation portion 22 to adjust a timing for separation into each color. The sensor 40 is disposed at a position so as to be able to reliably detect the passing cullet on the conveying belts 17.

The color discrimination device 41 has a function of discriminating and determining a color of the passing cullet upon a signal from the color discrimination camera 39, a function of controlling synchronization of the trigger signal (sensor 40) and the shutter of the color discrimination camera 39, and a function of transferring a signal etc. indicating the result of the color discrimination to the separation portion 22, as described later, for separating the cullet into each color. These signals are transferred via cables 41*a*, 41*b* and 41*c*.

The separation portion 22 functions to control the cullet, discriminated by the foreign glass discrimination portion 20 and the color discrimination portion 21, flowing one by one on the conveying belts 17 and to blow off the foreign glass and the cullet of each color for a respective collection. The separation portion 22 is disposed on the downstream side of the foreign glass discrimination portion 20 and the color discrimination portion 21, as shown in FIGS. 1 to 3. In the present preferred embodiment, the separation is performed in the order of the lesser mixing ratio from the upstream side (the side of the discrimination portions 20 and 21) into four kinds of the foreign glass, green, brown and colorless transparence and others including foreign matter.

The separation portion 22 is composed of collection bins or receptacles 42 (42*a*, 42*b*, 42*c*, 42*d* and 42*e*), electromagnetic valves 43 (43*a*, 43*b*, 43*c* and 43*d*) and air nozzles 44 (44*a*, 44*b*, 44*c* and 44*d*) for separating and collecting the foreign glass and the cullet of each color. The separation portion also includes foreign glass/color discrimination trigger photoelectric sensors 45 (45*a*, 45*b*, 45*c* and 45*d*) for detecting the passing cullet, a separation control device 28 for controlling a timing of blowing for separating the cullet so discriminated to the four kinds into the foreign glass and the cullet of each color, an electromagnetic valve open/close circuit 46 for opening and closing the electromagnetic valves 43 (43*a* to 43*d*) upon a signal from the separation control device 28 and cables 46*a* and 46*b* for transferring the signal.

The collectors 42 includes a foreign glass collection bin or receptacle 42*a*, a green color collection bin or receptacle 42*b*, a brown color collection bin or receptacle 42*c*, a colorless transparence collection bin or receptacle 42*d* and an "other" collection bin or receptacle 42*e*. The collection bin or receptacles 42*a* to 42*d* are disposed aside the conveying belts 17 in order from the upstream side, respectively, and the collection bin or receptacle 42*e* is disposed at a downstream end portion of the conveying belts 17. Also, on the other side of the conveying belts 17 and opposing each of the collection bins or receptacles 42*a* to 42*d* disposed are electromagnetic valves 43*a*, 43*b*, 43*c* and 43*d* for the foreign glass, green color, brown color and colorless transparence, respectively, and air nozzles 44*a*, 44*b*, 44*c* and 44*d* corresponding to each of the electromagnetic valves so as to form a pair, respectively. Compressed air is supplied to each of the electromagnetic valves 44*a* to 44*d* from an outside air source via a piping (not shown).

Further, on the upstream side of each of the air nozzles 44*a* to 44*d*, a pair of a light emitter, on one side of the conveying belts 17, and a light receiver, on the other side thereof, is provided for foreign glass separation and color separation trigger photoelectric (transparent substance detecting) sensors 45*a* to 45*d* for detecting the passing cullet and, upon its timing, causing the opening/closing of each of the electromagnetic valves 43*a* to 43*d*.

The electromagnetic valve open/close circuit 46 is a device for opening/closing each of the electromagnetic valves 43*a* to 43*d* upon receiving a command signal from the separation control device 28.

The separation control device 28 functions to control the speed of the drive motor (servomotor) of the conveying belts 17 and to control positions of the cullet on the slit 23 of the belts 17 upon receiving signals from the foreign glass discrimination trigger sensor 33, the color discrimination trigger sensor 40 and the encoder fitted to the drive motor and to cause each of the electromagnetic valves 43*a* to 43*d* to open and close and the air nozzles 44*a* to 44*d* to blow air in response to the foreign glass discrimination signal from the foreign glass discriminator 37, the cullet color discrimination signal from the color discrimination device 41 and the signals from the foreign glass separation trigger and color separation trigger photoelectric sensors 45*a* to 45*d*. The cullet is thereby separated so as to be collected in the collection receptacles 42*a* to 42*d* of the foreign glass and the cullet of each color and in the collection receptacle 42*e*.

The following is a description of a simple example of a control algorithm of the separation control device 28. Within the separation control device 28, a timer is installed as a program.

1) Upon the passing of the cullet on the slit 23, the foreign glass discrimination trigger photoelectric sensor 33 transfers a trigger signal to the timer. The timer starts a count in response to the trigger signal from the foreign glass discrimination trigger photoelectric sensor 33. The count is made based on the pulse signal of the encoder fitted to the drive motor 19 and this means a movement amount of the cullet from a detection position of the foreign glass discrimination trigger photoelectric sensor 33. On the other hand, the laser beam source 29 radiates the laser beam 29*a* on the surface of the cullet on the slit 23 upon the trigger signal of the photoelectric sensor 33. The emitted beam is converged by the emission convergent lens 34 and is transferred to the analyzer 36 via the optical fiber 35 for a spectrum analysis. The analyzed signal is transferred to the foreign glass discrimination device 37 for discrimination of a "yes or no" foreign glass determination, and further the discriminated signal is transferred to the separation control device 28.
2) The timer, if the foreign glass discrimination signal is of a foreign glass (yes), sets a count-up valve which corresponds to a distance to the foreign glass separation air nozzle 44*a*. As the cullet may in some case reach a count-up point late due to a slip with the conveying belts 17, etc., a distance of delay being taken into account, a valve opening enabling signal is formed with a time corresponds to the distance of delay of the cullet from the count-up point for enabling ejection of the cullet by the foreign glass air nozzle 44*a*. When the cullet passes the air nozzle 44*a*, the foreign glass separation trigger photoelectric sensor 45*a* is turned to "ON". While the valve opening enabling signal is "ON", if the separation trigger photoelectric sensor (for the foreign glass) 45*a* becomes "ON", a logical product of both signals becomes "ON" and the foreign glass separation electromagnetic valve 43*a* is turned to "ON" for a certain time (passing time of the cullet) via the electromagnetic valve open/close circuit 46. When the foreign glass separation air nozzle 44*a* opens, the cullet is blown toward the foreign glass collection receptacle 42*a*. Incidentally, the timer is allotted each in the order of the passing cullet and makes the respective count-up to a maximum number of the cullets placeable on the conveying belts 17.

Likewise, a case of a color cullet is described:

1) Upon the passing of the cullet on the slit 23, the color discrimination trigger photoelectric sensor 40 works and transfers a trigger signal to the timer. The timer starts a count in response to the trigger signal from the color discrimination trigger photoelectric sensor 40. The count is made based on the pulse signal of the encoder fitted to the drive motor 19 and this means a movement amount of the cullet from a detection position of the color discrimination trigger photoelectric sensor 40. On the other hand, the color discrimination camera 39 opens a camera shutter in response to the trigger signal from the color discrimination trigger photoelectric sensor 40. An image signal is transferred to the color discrimination device 41 for a concurrent color decision of the passing cullet, and its signal is transferred to the separation control device 28. Based on this color signal, the timer sets a count-up value which corresponds to a distance to the respective separation trigger photoelectric sensor 45 (45*b*, 45*c* and 45*d*). For example, if the passing cullet is green, a movement amount from the photoelectric sensor 40 to the green color air nozzle 44*b* is set. The following is a description of the passing of a green colored cullet.

2) As the cullet may in some case reach a count-up point late due to a slip with the conveying belts 17, etc., a distance of delay is taken into account, and a valve opening enabling signal is formed with a time which corresponding to the distance of delay of the cullet from the count-up point for enabling ejection of the cullet by the green color air nozzle 44*b*. When the cullet passes the green color air nozzle 44*b*, the separation trigger photoelectric sensor (for green color) 45*b* is turned to "ON". While the valve opening enabling signal is "ON", if the separation trigger photoelectric sensor 45*b* becomes "ON", a logical product of both signals becomes "ON" and the green color electromagnetic valve 44*b* is turned to "ON" for a certain time (passing time of the cullet) via the electromagnetic valve open/close circuit 46. When the green color air nozzle 44*b* opens, the cullet is blown toward the green color collection receptacle 42*b*.

In a case of cullets of brown color and also colorless transparence, a timer count-up and a respective valve opening enabling signal corresponding thereto are formed and a separation into each color becomes possible.

It is to be noted that, if a color discrimination signal is "other" or if a discrimination is impossible, the valve opening enabling signal does not become "ON" and the cullet is not ejected by the air nozzle 44 but instead flows into the collection receptacle 42*e*.

As mentioned above, the respective cullet supplied from the upstream side is blown into the collection receptacles 42*a*, 42*b*, 42*c* and 42*d* of the foreign glass and the cullet of each color, and the cullet determined as an "other" is not ejected but is collected in the collection receptacle 42*e*.

It is to be noted that, while in the above preferred embodiment a separation into a total of five kinds of the foreign glass, green color, brown color, colorless transparence and others is possible, a construction of an arbitrary combination is also possible according to separation purpose, usage, etc. with respect to glass kinds, color kinds or separation numbers other than those mentioned above.

Also, in the above preferred embodiment, an example of separation into the foreign glass and the cullet of each color is shown, but separation into colors only is possible and yet separation according to separation purpose, usage, etc. can be achieved.

A construction of the apparatus in that case becomes realized for a color discrimination and separation of the cullet flowing on the conveying belts 17 by removing the collection receptacle 42*a*, the electromagnetic valve 43*a*, the air nozzle 44*a* and the separation trigger photoelectric sensor 45*a* from the foreign glass discrimination portion 20 (composed of numerals 29 to 34) and the separation portion 22 thereof as shown in FIGS. 1 to 3.

According to the glass cullet separation apparatus of the above preferred embodiment, the following effects are obtained:

(1) By the construction of the present separation apparatus, automation of the cullet color separation work becomes possible.

(2) By the construction of the present separation apparatus, the foreign glass cullet separation becomes practicable by an automatic process.

(3) By the construction of the present separation apparatus, the cullet can be supplied at a high speed while it is being arrayed and control of the foreign glass discrimination and color discrimination, the passing time (moving distance), the nozzle blowing timing, etc. with respect to each of the passing cullet can be achieved in realtime, thus high speed and high purity separation becomes possible.

(4) By the construction of the present separation apparatus, a series of steps of supplying, arraying, foreign glass discriminating and color discriminating of the cullet and separating and collecting of the discriminated cullet can be performed with a single line and it becomes possible to make the apparatus compact.

(5) By the high speed treatment and high collection purity, reduction of apparatus cost per unit amount of treatment becomes possible.

(6) By so making the apparatus compact, reduction of installation space per unit amount of treatment and reduction of cost of building, land, etc. become possible.

According to the present invention as described above in detail, the problems in the prior art can be solved with regard to cullet color separation work and recycling. Also, treatment number per unit time can be increased and small sizing of the apparatus and enhancement of the separation accuracy can be attained. Thus, a glass cullet separation apparatus separating foreign glass (heat resistant glass) which is a large obstacle in glass bottle recycling and for separating colors for recycling can be provided.

While there have been described preferred embodiments of the invention, modifications and variations are possible in light of the above teachings. It is therefore to be understood that within the scope of the appended claims, the invention may be practiced other than as specifically described herein.

What is claimed is:

1. A cullet separation apparatus comprising:

a hopper for holding glass cullet containing foreign glass and for supplying the cullet in a downstream direction at a certain rate;

an arraying and supplying means for rotationally accelerating the cullet supplied from said hopper and for arraying the cullet in a row due to a centrifugal force, and for delivering the cullet continuously downstream;

a cullet conveying belt;

an inclined connection plate disposed between said arraying and supplying means and said cullet conveying belt for accelerating a differential component of a speed of the cullet from said arraying and supplying means and a speed of said cullet conveying belt, wherein said conveying belt has a slit;

a belt movement amount measuring means for measuring the amount of movement of said cullet conveying belt;

a foreign glass discrimination device for radiating a laser beam onto a surface of the cullet passing over said conveying belt slit;

a color discrimination device for projecting an illumination light through said conveying belt slit and for discriminating a color of the cullet by taking an image of a transmission light through the cullet;

a first non-contact type photoelectric sensor for triggering said foreign glass discrimination device;

a second non-contact type photoelectric sensor for triggering said color discrimination device;

a plurality of air nozzles for ejecting detected foreign glass and colored cullet at predetermined positions, respectively, in order to separate the cullet, wherein each of said air nozzles includes an electromagnetic valve for controlling air discharge;

at least one third non-contact type photoelectric sensor for sensing a passing of the cullet at said air nozzles;

a plurality of collection devices, disposed adjacent said conveying belt, for receiving the cullet ejected from said conveying belt by said air nozzles; and a control device for controlling opening and closing of said electromagnetic valves upon receiving one of the following signals:

1) a foreign glass discrimination trigger signal emitted from said first non-contact type photoelectric sensor;
2) a color discrimination trigger signal received from said second non-contact type photoelectric sensor;
3) a foreign glass signal received from said foreign glass discrimination device;
4) a cullet color signal received from said color discrimination device;
5) a belt movement distance pulse signal received from said belt movement amount measuring means; and
6) an electromagnetic valve trigger signal received from said third non-contact type photoelectric sensor.

2. The glass cullet separation apparatus as claimed in claim 1, wherein said arraying and supplying means comprises a rotary feeder including:

a rotary disc having a circumferential wall; and a discharge port provided at said circumferential wall for discharging the cullet in a tangential direction relative to said rotary disc.

3. The glass cullet separation apparatus as claimed in claim 1, wherein said control device is operable:

to start detection of a cullet movement amount by said belt movement amount measuring means upon triggering of the foreign glass discrimination trigger signal and the color discrimination trigger signal, to control the cullet movement amount by use of the belt movement distance pulse signal and to produce, upon receipt of the foreign glass discrimination signal and the cullet color discrimination signal, an electromagnetic valve enabling signal for the electromagnetic valve of the respective air nozzle corresponding to the foreign glass and the cullet of each color, said electromagnetic valve enabling signal taking into account any slippage between said conveying belt and the cullet based on a reference time that the cullet would have reached the electromagnetic valve trigger sensor if no slippage had occurred, wherein an electromagnetic valve opening signal is produced by a logical product of said electromagnetic valve enabling signal and the electromagnetic valve trigger signal.

4. The glass cullet separation apparatus as claimed in claim 1, wherein said collection devices are arranged along the cullet conveying belt, such that the type of cullet representing the smallest ratio of the total cullet is collected upstream of the remaining types of cullet.

5. The glass cullet separation apparatus as claimed in claim 1, wherein said color discrimination device is operable to perform a plurality of color discriminations.

6. A cullet separation apparatus comprising:

a hopper for holding glass cullet and for supplying the cullet in a downstream direction;

a rotary feeder, positioned adjacent said hopper, for feeding the cullet received from said hopper in the downstream direction;

a-belt conveyor having an upstream end and a cullet support surface in which a slit is provided;

an inclined connection plate disposed between said rotary feeder and said upstream end of said belt conveyor;

a belt movement amount measuring device for measuring the amount of movement of said belt conveyor;

a foreign glass discrimination device for radiating a laser beam onto a surface of the cullet passing over said belt conveyor slit;

a color discrimination device for projecting a light through said belt conveyor slit and for discriminating a color of the cullet by taking an image of a transmission light through the cullet;

a first non-contact type photoelectric sensor for triggering said foreign glass discrimination device;

a second non-contact type photoelectric sensor for triggering said color discrimination device;

a plurality of air nozzles for ejecting cullet at predetermined positions along said belt conveyor in order to separate the cullet, wherein each of said air nozzles includes an electromagnetic valve for controlling air discharge;

at least one third non-contact type photoelectric sensor for sensing a passing of the cullet at said air nozzles;

a plurality of collection devices, disposed adjacent said conveying belt, for receiving cullet which is ejected from said conveying belt by said air nozzles; and a control device for controlling opening and closing of said electromagnetic valves upon receiving one of the following signals:

1) a foreign glass discrimination trigger signal emitted from said first non-contact type photoelectric sensor;
2) a color discrimination trigger signal received from said second non-contact type photoelectric sensor;
3) a foreign glass signal received from said foreign glass discrimination device;
4) a cullet color signal received from said color discrimination device;
5) a belt movement distance pulse signal received from said belt movement amount measuring device; and
6) an electromagnetic valve trigger signal received from said third non-contact type photoelectric sensor.

7. The glass cullet separation apparatus as claimed in claim 6, wherein said rotary feeder comprises:

a rotary disc having a circumferential wall; and a discharge port provided adjacent said circumferential wall for discharging the cullet in a tangential direction relative to said rotary disc.

8. The glass cullet separation apparatus as claimed in claim 6, wherein said color discrimination device is operable to perform a plurality of color discriminations.

* * * * *